United States Patent [19]

Clayton

[11] Patent Number: 5,036,873

[45] Date of Patent: Aug. 6, 1991

[54] ADJUSTABLE CRUTCH ASSEMBLY

[76] Inventor: Raul Clayton, 9435 Fountainbleu Blvd., Miami, Fla. 33172

[21] Appl. No.: 559,131

[22] Filed: Jul. 30, 1990

[51] Int. Cl.[5] ..... A61H 3/02

[52] U.S. Cl. ..... 135/69; 135/75; 135/72; 403/108

[58] Field of Search ..... 135/68–70, 135/72, 75; 403/108, 107, 328

[56] References Cited

U.S. PATENT DOCUMENTS

| | | | |
|---|---|---|---|
| 2,630,128 | 3/1953 | Slater | 135/69 |
| 2,682,275 | 6/1954 | Eyrich | 135/70 |
| 3,417,765 | 12/1968 | Slater et al. | 135/69 X |
| 3,712,652 | 1/1973 | Uilkema | 403/108 |
| 4,181,230 | 1/1980 | Acuff | 403/108 X |
| 4,252,137 | 2/1981 | Cohen | 135/69 |
| 4,252,138 | 2/1981 | Fowler | 135/69 |
| 4,253,479 | 3/1981 | Laurent | 135/69 |
| 4,456,285 | 6/1984 | Weber-Henning | 135/75 X |

FOREIGN PATENT DOCUMENTS

| | | | |
|---|---|---|---|
| 149576 | 4/1984 | European Pat. Off. | 135/75 |

*Primary Examiner*—David A. Scherbel
*Assistant Examiner*—Lan Mai
*Attorney, Agent, or Firm*—James Wetterling

[57] ABSTRACT

A crutch assembly capable of having its longitudinal dimension adjusted by a movable lower leg member selectively positionable between an outwardly extended position and an inwardly retracted position through operation of a trigger mechanism. The trigger mechanism either attaches or releases the lower leg portion relative to an elongated base of the crutch and prevents or allows movement of the lower leg portion between the extended and retracted positions due to force exerted on the lower leg member by a biasing spring or by gravity. The height of the crutch is thereby selectively adjusted for adaptation to different elevations of the surface over which a user travels such as when traversing steps, stairs, ramps, etc.

12 Claims, 4 Drawing Sheets

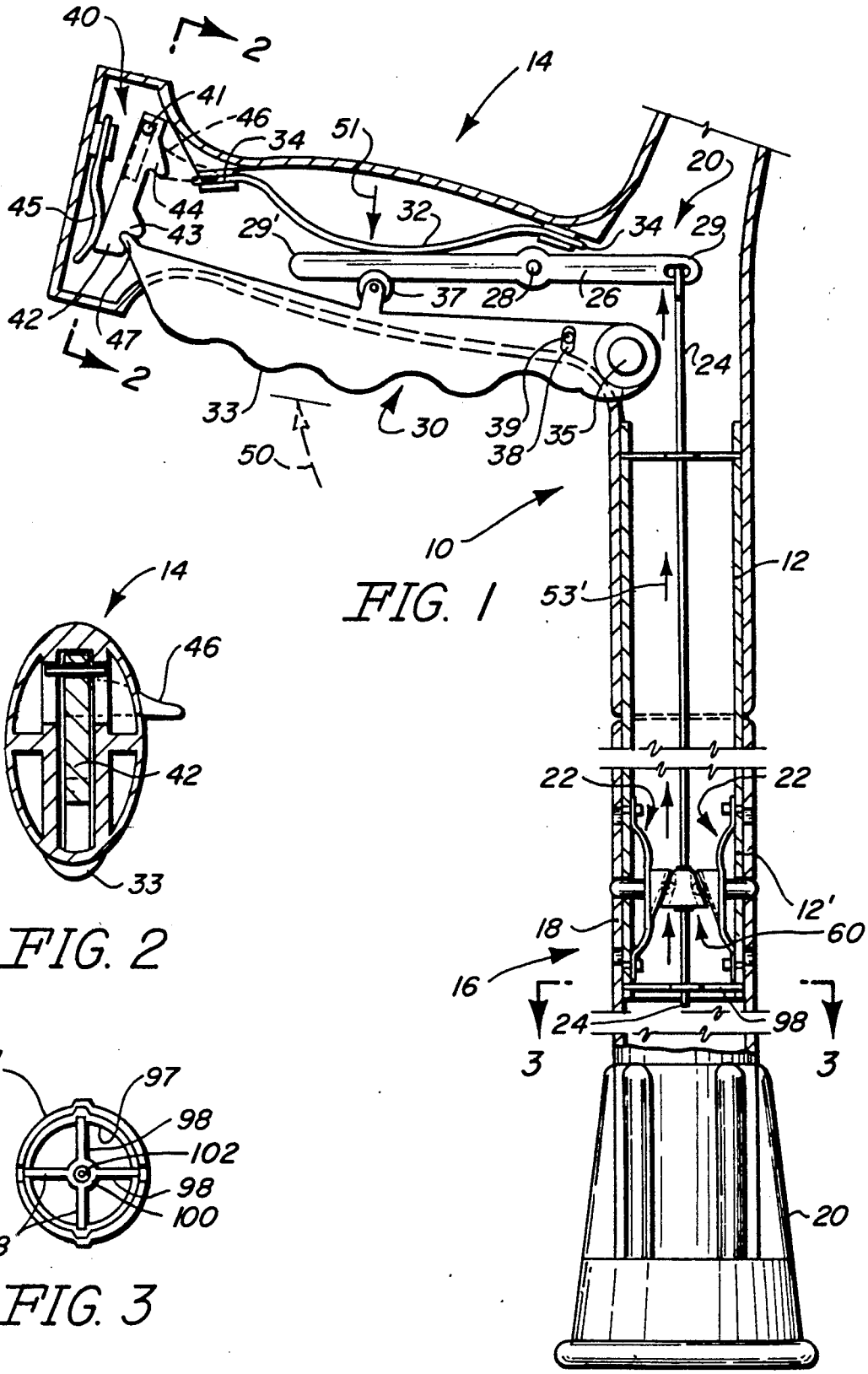
FIG. 1
FIG. 2
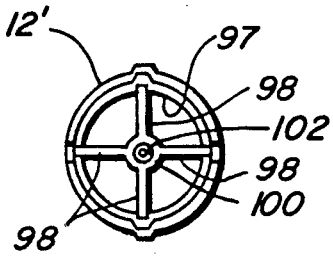
FIG. 3

ADJUSTABLE CRUTCH ASSEMBLY

BACKGROUND OF THE INVENTION

1. Field of the Invention

This invention relates to a crutch assembly which may have its longitudinal dimension selectively increased or decreased to accommodate different heights or elevations of walking surfaces over which a user of the crutch may travel.

2. Description of the Prior Art

Existence in the prior art of crutch structures which are capable of having their length adjusted are well known in the art. Typically, such known crutch structures are built primarily to accommodate use by people of varying heights. Alternately, there exists in the prior art crutch structures which are substantially collapsible for purposes of storage and ease in transportation when not in use.

U.S. Pat. No. 4,917,126 to Ellmore is representative of at least one type of the above-described prior art crutches. The structure disclosed in this patent relates to a stowable crutch including a body consisting of a first and second tube secured to each other and a third tube being slidably mounted within the first tube. A fourth tube to which an underarm support is secured is slidably mounted within the second tube. The various first, second, third and fourth tubes are all relatively adjustable so as to selectively dispose the crutch assembly of this invention between an extended, operative position and a collapsed, stowable position.

The patent to Chen, U.S. Pat. No. 4,865,065 is directed to an improved height adjustable crutch having a central carrier member telescopingly received within an extendable leg member. The extendable member is adjustable by sliding movement and fixed into an operative position by the provision of a biasing spring or locking devise to interconnect fixed and sliding members.

The U.S. Pat. No. 3,417,765 to Slater, et al., discloses a telescoping crutch having an upper support portion designed to fit beneath the arm of the user and being spring biased and accordingly outwardly adjustable. Similarly, a lower leg portion is outwardly extendable and adjustable. Both the longitudinally adjustable members are extendable and fixed into an operative position by the existence of hand manipulated connectors.

U.S. Pat. Nos. 2,674,253 to Hopkins and 3,157,189 to Farnham are both directed to a "automatically" adjustable length crutches in the sense that the length of the crutch may be adjusted essentially while being used and while in its generally operable position without necessitating the user to physically manipulate the parts relative to one another. To the contrary, Hopkins discloses a spring biased lower leg member which, upon actuation of a trigger, serves to activate a plurality of elongated lengths or actuating rods externally mounted. Each of the lengths are connected to a stop member cooperating with an externally located gear extending along the length of the lower extendable leg. Manipulation of the trigger mechanism serves to operate the rather complicated linkage and break or stop members causing the relative movement of the lower leg portion to the remainder of the crutch. While operable for its intended function, the Hopkins structure appears to be overly complicated, and obviously has many of its working components externally accessible, thereby rendering them accessible for inadvertent damage. Further, the complication of the Hopkins structure renders it questionable for commercial application.

Farnham is extendable through operation of an electric motor and, accordingly, is questionable from an expense standpoint and also renders such a crutch structure possibly too heavy or inconvenient for use in commercial application.

SUMMARY OF THE INVENTION

The present invention relates to an adjustable length crutch assembly of the type designed to aid a user in traversing stairs, ramps or other surfaces of varying heights. The crutch assembly comprises an elongated base extending along and defining a major portion of the length of the crutch assembly. The base has a hollow interior extending entirely along its length. A handle is secured to the base and extends substantially transversely outward therefrom. The handle is disposed and configured for gripping by the hand of the user. It should be apparent that the crutch assembly of the present invention may take various forms such as of the type pictured which is designed to be gripped by the hand of the user as well as support the forearm or other portions of the arm of the user. Alternately, the crutch may take a more conventional configuration wherein a support may be mounted on the upper end of the crutch assembly which is designed to fit under the arm in the area of the shoulder.

In either of the above-noted embodiments, the crutch assembly comprises an actuating means. The actuating means comprises an elongated actuating rod mounted within the interior of the base and extending along generally at least a majority of the length thereof. An arm is pivotally attached to an upper end of the rod and extends transversely into the interior of the handle where it cooperates with a trigger means. The trigger means is secured to the handle and may include a grip portion being exteriorly accessible and movable, by manipulation of the hand of the user, so as to position the actuating means between what may be referred to as a locked position and a released position.

A safety mechanism is connected to the handle of the crutch assembly and is structured to cooperate with the grip portion of the trigger means. The safety mechanism is structured so that the trigger mechanism cannot be inadvertently actuated so as to inadvertently move the actuating means into a released position which will cause disengagement of a lower, extendable leg member from the base, thereby allowing it to move to an outwardly extended position. The safety mechanism may also be manipulated by the hand which surrounds and/or grips the handle. When properly positioned, the safety mechanism effectively releases the grip portion of the trigger means thereby allowing it to force the actuating means into a released position from a normally locked position. Once in a released position, the actuating means serves to operate a locking means and move such locking means from a locked position between the lower leg member and the base and a released position between these two members.

When in the released position, the lower leg portion can move either under the force of gravity or a biasing spring into an outwardly extending position or back into a retracted position depending upon the intent of the user of the crutch assembly.

The above-noted locking means of the present invention comprises at least one but preferably two or more locking members each attached to a biasing structure and disposed and dimensioned to cooperate with a first aperture formed in the wall of the base so as to pass therethrough and a plurality of spaced apart aligned second apertures formed in the extendable leg member which is telescopically mounted generally onto the bottom of the base. The aforementioned locked position is defined by each of the lock members extending through the correspondingly positioned ones of the first apertures formed in the base and also extending through at least one of the plurality of spaced apart aligned second apertures formed in the leg member. The leg member and the base are, therefore, fixedly interconnected and the position of the leg member is fixed relative to the base either in an outwardly extending position or a retracted position depending upon the desired height or length of the crutch assembly intended by the user.

A positioning means is mounted in cooperative relation with both the actuating rod and the locking means. The positioning means includes a first positioning member secured to and movable longitudinally with the actuating rod. The positioning means further includes a plurality of second positioning members corresponding in number to the number of lock members. The first positioning member includes a somewhat truncated wedge type configuration having oppositely disposed angularly oriented surfaces. Each of the second members include cooperatively disposed and congruently oriented surfaces such that longitudinal movement of the actuating rod and first positioning member will cause outward, transverse travel or expansion of the two positioning members thereby forcing the lock members associated therewith outwardly against the biasing force of the respective biasing structures and through aligned ones of the first and second apertures formed in the leg and base. The lock members therefore fixedly interconnect the leg to the base thereby preventing its movement and assuring a fixed positioning of the leg either in a retracted position or outwardly extended position.

BRIEF DESCRIPTION OF THE DRAWINGS

For a fuller understanding of the nature of the present invention, reference should be had to the following detailed description taken in connection with the accompanying drawings in which:

FIG. 1 is a longitudinal sectional view showing interior structural details of the various components of the present crutch assembly invention.

FIG. 2 is a transverse sectional view along line 2—2 of FIG. 1.

FIG. 3 is a transverse sectional view along line 3—3 of FIG. 1.

Like reference numerals refer to like parts throughout the several views of the drawings.

DETAILED DESCRIPTION OF THE PREFERRED EMBODIMENT

Figure 5:
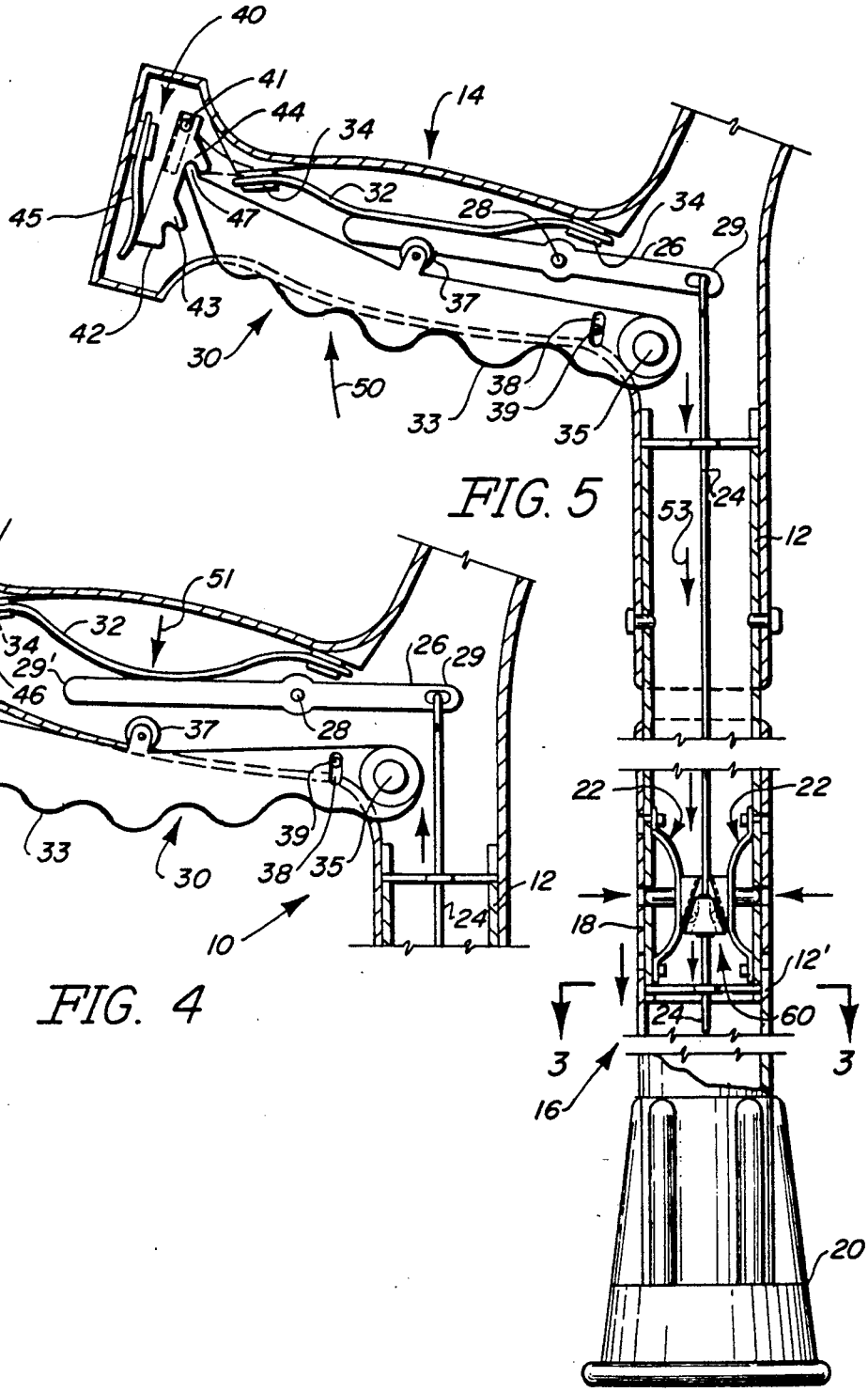
FIG. 5 is a longitudinal sectional view showing the components in a next position.
Figure 4:
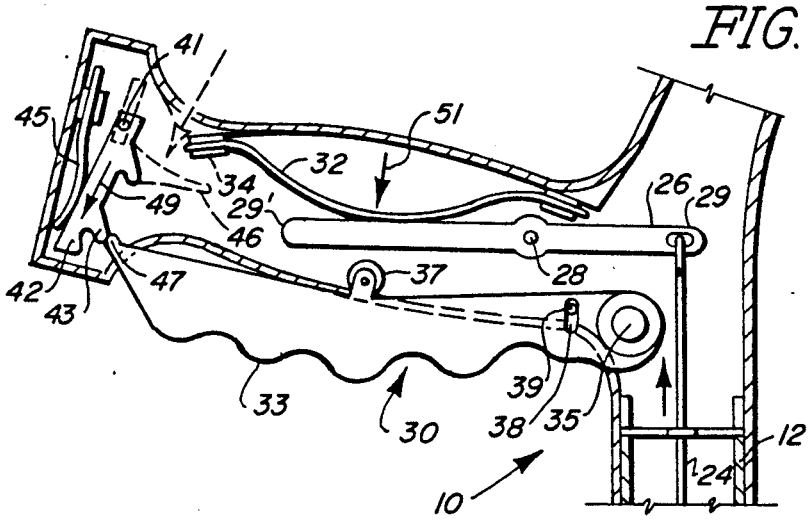
FIG. 4 is a sectional view and partial cutaway showing the various components in a first position.
Figure 6:
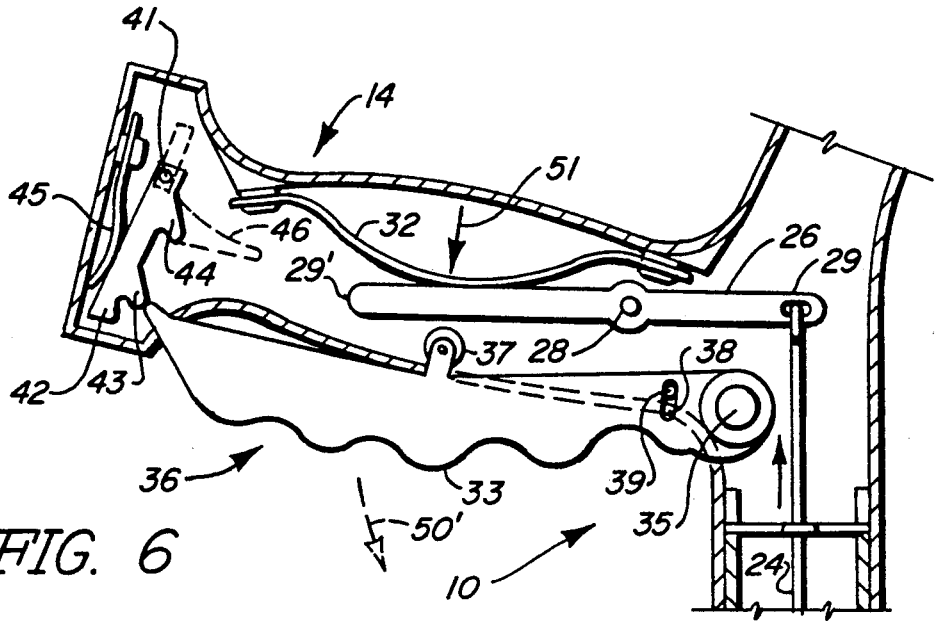
FIG. 6 is a sectional view and partial cutaway of the embodiment of FIG. 4 in a position similar to that of FIG. 4.
Figure 7:
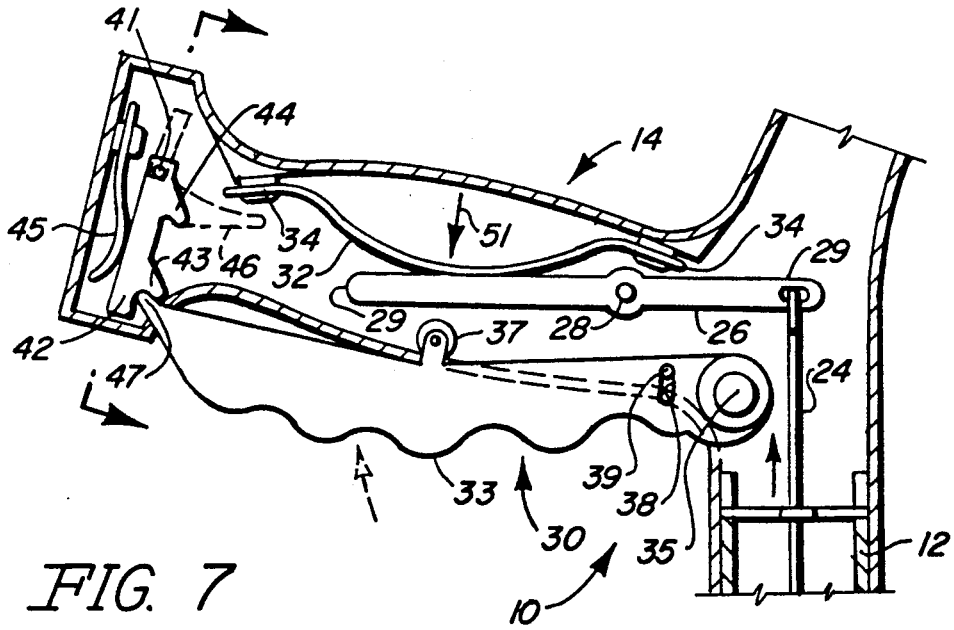
FIG. 7 is a sectional view showing the various components of the embodiment of FIGS. 1 and 4 in the position of FIG. 1.
Figure 8:
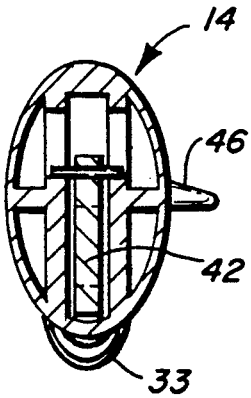
FIG. 8 is a transverse sectional view along line 8—8 of FIG. 7.

As shown in the accompanying figures, the present invention is directed towards a crutch assembly generally indicated as 10. The crutch assembly 10 includes an elongated substantially hollow base 12 extending along at least a majority of the length of the crutch assembly 10. A handle generally indicated as 14 is secured to the base and extends substantially transversely outward therefrom. Further, the handle 14 is generally configured to be gripped by the hand of the user. The crutch assembly 10 also includes a lower leg portion 16 movable longitudinally relative to the base and being concentrically mounted along a lower portion thereof as at 12'.

Accordingly, the lower leg portion 16 includes a hollow interior substantially tubular configuration as at 18 terminating in a free end by the mounting of a rubber or like tip portion 20 thereon. As will be explained in greater detail hereinafter, the length or height of the crutch assembly 10 when in its upright, operable position may be varied by extending or retracting the lower leg 16 relative to the base by manipulation of an actuating means generally indicated as 20. The lower leg 16 may be selectively disposed between an outer extended position or a retracted position relative to the lower end of the base 12' and fixed in either retracted or extended position through the provision of a locking means 22, best shown in detail in FIGS. 9 and 10. Again, with primary reference to FIGS. 1 and 4 through 7, the actuating means comprises an elongated actuating rod 24 mounted within the interior of the base and including an arm portion 26 attached or connected to an upper end thereof. The arm 26 is pivotally mounted to extend at least partially within the interior of the hollow structured handle 14 as at 28. The one interior end 29 may be movably attached to a correspondingly positioned end of the actuating rod 24. A free end as at 29' of the arm 26 is disposed in cooperative relation with a trigger means generally indicated as 30. In addition, a first biasing spring 32 includes an elongated configuration having opposite ends fixedly secured to the handle as at 34. The biasing spring 32 is positioned to normally bias the arm 26 of the actuating means 20 generally towards the trigger means 30. The trigger means comprises a grip portion 33 which is exteriorly accessible and generally configured to be gripped by one or more fingers of the hand of the user as that hand surrounds or otherwise grips the handle 14 of the crutch assembly 10. The grip portion 33 is pivotally secured as at 35 and includes a contact member 37. Also, a guide and retaining structure associated with the grip 33 includes an outwardly extending pin 39 mounted within a somewhat elongated groove 38. The retaining pin and groove 39 and 38, respectively, serve to limit the amount of travel of the grip as it is pressed inwardly or normally biased outwardly due to the action of the hand of the user and/or the biasing spring structure 32. Further, the contact member 37 may be in the form of a peripherally grooved roller slidably mounted at least minimally along the length of the arm 26.

A trigger safety means is generally indicated as 40 and includes a movably mounted ratchet type structure 42 having at least one but preferably a plurality of outwardly extending retaining fingers 43 and 44. The ratchet structure 42 is engaged and biased inwardly by a spring member 45 towards and into engagable relation with an outermost free end 47 of the grip 33. When in the position shown in FIGS. 1 and 7, the grip 33 is prevented from being pivoted inwardly into actuating relation to the arm 26. However, upon a downward thrust of a finger operated lever 46 by the hand of the user, the ratchet 42 is moved to a released position as initially indicated in FIG. 4. The directional arrow 49 indicates a downward and somewhat outward travel of the ratchet 42 about a pivot 41 to the point where the free end 47 of the grip 33 is allowed to clear the outwardly extending catch or finger 43. The grip 33 is thereby allowed to be forced inwardly (see directional arrows 50 in FIGS. 1, 5 and 6) by the hand of the user and against the biasing force of the biasing spring 32 as generally represented by the directional arrow 51. When forced inwardly (see FIG. 5) in accordance with the directional arrow 50, the grip 33 forces the contact member 37 into driving engagement with the arm 26 and against the biasing force offered by the spring 32. This serves to longitudinally move the actuating rod 24 (see directional arrow 53) so as to move the actuating rod 24, the lock means 22 and a positioning means 60 into what may be referred to as a released position from the locked position as represented in FIG. 1.

Figure 9:
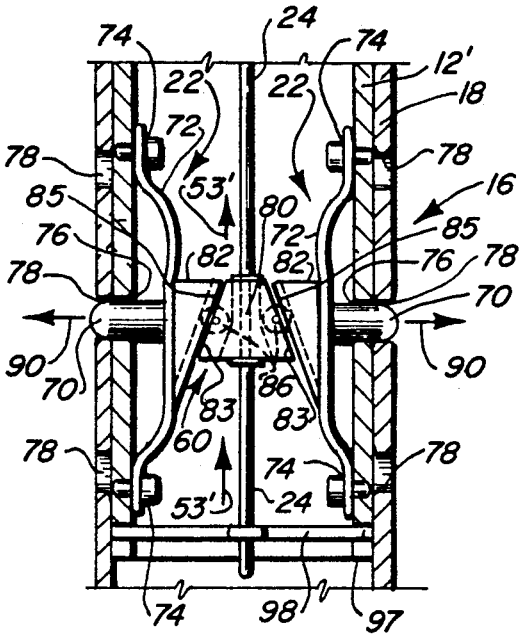
FIG. 9 is a sectional view and partial cutaway showing details of a locking mechanism of the present invention in a locked position.
Figure 10:
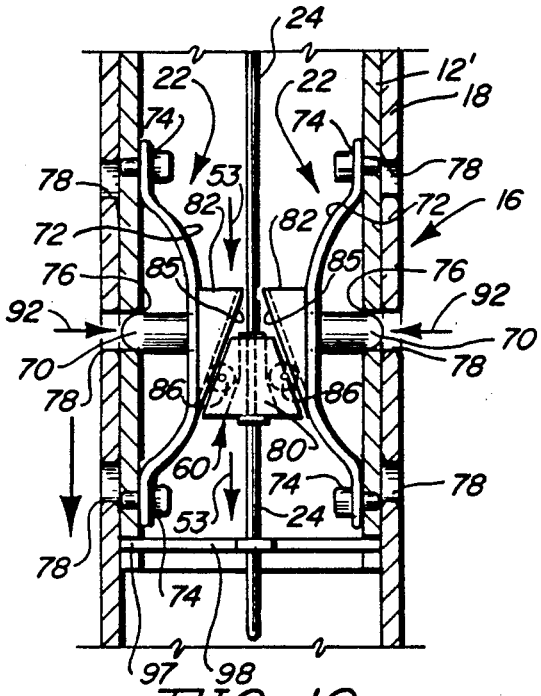
FIG. 10 is a sectional view and partial cutaway showing the locking mechanism of the embodiment of FIG. 9 in a released position.

The released position referred to above and explained in detail hereinafter with reference to FIGS. 9 and 10 is defined by the effective disconnection of the tubular structure 18 of the lower leg 16 from the lower end 12' of the base. Movement of the leg is thereby allowed relative to the base causing either a retraction or outer extension of the lower leg 16 and an overall change in the length or "height" of the crutch assembly 10 when it is in its operative position.

The provision of the trigger safety means 40 is such as to prevent inadvertent movement and positioning of the actuating means 20 including the actuating rod 24 and positioning means 60 so as to not inadvertently free or disconnect the lower leg 16 from the base 12.

However, with reference to FIGS. 4 through 8, release of the grip 33 of the trigger means 30 will cause the biasing spring 32 to force the arm 26 to pivot about the pivot structure 28 as the contact member 37 disengages the arm 26. This will cause a "lifting" of the actuating rod 24 as indicated by directional arrow 53' (see FIG. 1) and a forcing of the positioning means 60 and the lock means 22 back into a locked position (see FIGS. 1 and 9) from a released position (see FIGS. 5 and 10). The various steps or stages of travel of the various components as the grip 33 of the trigger means 30 is released is indicated clearly in FIGS. 6 and 7. More specifically, in FIG. 6 the grip of the user by his hand is released from the grip portion 33 of the trigger means 30. This is indicated by directional arrow 50'. The action of the biasing spring 32 on the arm 26 causes the outward travel of the grip 33 due to engagement of the grip 33 through contact 37 with the arm 26. The grip 33 thereby moves outwardly in accordance with directional arrow 50' into in past engagement with the protruding retaining finger 43 from its stopped position with the retaining finger 44 (see FIG. 5). The outwardly extending finger 46 is thereby moved back into its initial actuating position as represented in FIG. 2. Eventually, the force of the biasing spring 32 will force the grip portion 33 back into its safety locked position in retaining engagement with the protruding finger 43 of the ratchet 42 as clearly shown in FIG. 7.

With reference to FIGS. 9 and 10, the locking means 22 comprises at least one but preferably or a plurality of lock members 70 each secured to a second biasing means in the form of two elongated biasing structures 72 normally disposed to bias the lock members 70 outwardly into fixed interconnection between the tubular structure 18 of the lower leg portion 16 and the lower end of the base 12'. Each of the biasing structures 72 are fixed to the interior of the base 12 and/or 12' as at 74. Further, the locking means includes at least a first set of openings or apertures as at 76 fixedly formed in the lower base end 12' in aligned relation with the lock members 70 such that such lock members 70 are normally biased to protrude therethrough by their attachment to the biasing structure 72. In addition, the locking means includes a plurality of spaced apart and aligned second apertures 78 also being dimensioned and disposed to allow one of the lock members 70 to pass therethrough as best shown in FIG. 9. Accordingly, the locked position as shown in FIG. 9 occurs when the lock members pass through both first and second aligned apertures 76 and 78 so as to fixedly interconnect the tubular structure 18 of the lower leg 16 relative to the lower end of the base 12'. The lower leg 16 is thereby prevented from movement relative to the base 12 and cannot move between a retracted or outwardly extended position.

The released position is represented in FIG. 10 wherein the lock members 70 are normally biased into the position shown in FIG. 10 so as to not protrude through both aligned first and second apertures 76 and 78. In such released position, the lower leg 16 is movable longitudinally relative to the lower end 12' of the base 12 and can therefore be selectively positioned between an outwardly extended or retracted position.

An important feature of the present invention is the provision of the positioning means 60. The positioning means 60 includes a first positioning member 80 secured to and movable with the actuating rod 24 and also movable relative to a plurality of second positioning members 82 corresponding in number to the lock members 70 and also being mounted on corresponding biasing structure 72.

The first positioning member 80 has angularly oriented actuating surfaces as at 83 cooperatively disposed to congruently oriented and configured angularly oriented surfaces 85 formed on the second positioning members 82. A roller or like structure serves to drivingly engage each of the actuating surfaces 83 with the correspondingly positioned actuating surfaces 85 wherein these actuating rollers are indicated as 86. Based on the structure as described with reference to FIGS. 9 and 10, it should be obvious that forced movement of the actuating rod 24 in accordance with directional arrow 53' causes the first positioning member 80 to move upwardly with the rod 24 in accordance with directional arrow 53' as the trigger mechanism including grip 33 is allowed to assume the position shown in FIGS. 1 and 7. The upward movement of the first positioning member 80 forces the outward transverse travel of the second positioning members 82 causing the lock member 70 to also move transversely outward against the biasing force provided by the spring members 72 as indicated by directional arrow 90. The lock members 70 are thereby forced into the locked position as they pass through aligned apertures 76 and 78 causing fixed interconnection between the lower leg 16 and the lower end 12' of the base. To the contrary, when the actuating rod 24 is forced to move in the opposite direction in accordance with directional arrows 53, the first positioning members 80 also moves in this direction allowing the lock member 70 to move inwardly in accordance with directional arrows 92 due to the force normally exerted on the lock members 70 by the biasing spring 72. The lower leg 16 is thereby disconnected and is now in a released position allowing it to be positioned either in a retracted or extended position thereby varying the length of the crutch assembly 10 as desired. Movement of the first member 80 in the position in accordance with directional arrows 53 is allowed by the forced inward positioning of the grip 33 of the trigger means 30 in accordance with the directional arrow 50 as best shown in FIG. 5.

Figure 11:
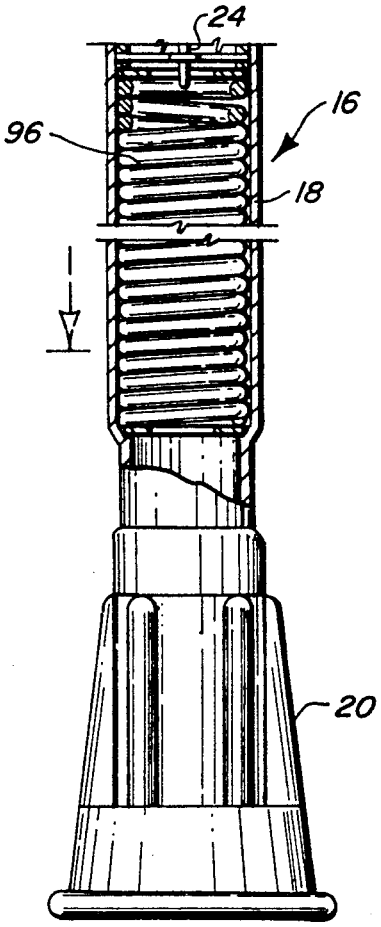
FIG. 11 is a transverse sectional view of a lower leg portion of the subject crutch assembly in a retracted position.
Figure 12:
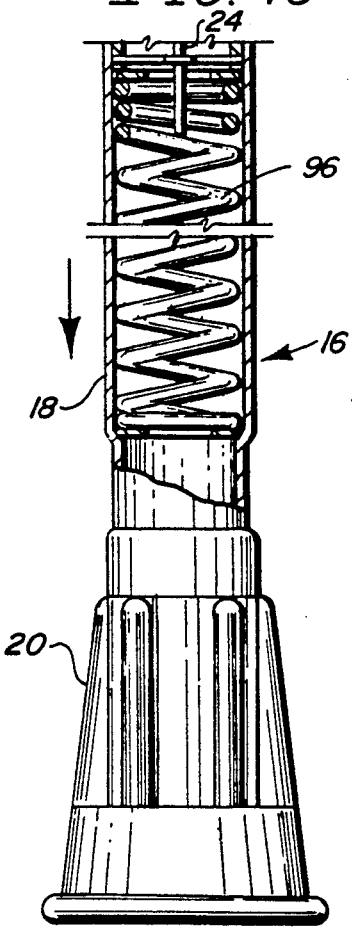
FIG. 12 is a sectional view similar to the embodiment of FIG. 11 but in an outwardly extended position.

It should be noted that an additional biasing spring as at 96 may be used to aid the travel of the lower leg member 16 in an outwardly directed extended position as shown in FIGS. 11 and 12 when the lock members serve to disconnect the lower leg member 16 from the lower end 12' from the base. Alternately, gravity may be used to normally allow the movement of the lower leg member 16 relative to the lower end 12' of the base without the aid of such biasing spring 96.

Other features associated with the present invention are best represented in FIGS. 1, 3, 9 and 10 and include a guide and support member as at 98 including a plurality of legs extending outwardly from a central engaging member 100 which is centrally apertured as at 102 in order to slidingly receive the corresponding end or portion of the actuating rod 24 therein. The support 97 is also mounted on the lower end 12' of the base 12.

Now that the invention has been described,

What is claimed is:

1. A crutch assembly designed to be longitudinally adjustable, said assembly comprising:

(a) a base having a hollow interior and an elongated configuration and including a handle transversely oriented along the length of said base in spaced relation to an upper end thereof, (b) an elongated leg member slidably mounted on the lower end of said base and movable along a length of said base between an extended position and a retracted position, (c) activating means mounted on said base and structured for fixedly connecting and disconnecting said leg portion relative to said base, (d) said activating means comprising an elongated activating rod extending within and along the length of said base and an arm portion connected to said activating rod and movable therewith and mounted within said handle, (e) locking means mounted on said base and positionable between a locked position and a released position relative to interconnection between said base and said leg member, (f) said locking means comprising at least two lock members movably mounted within said base and selectively positionable into said locked position, said locked position defined by concurrent engagement of each lock member with both said base and said leg member, (g) a plurality of biasing structures each secured to and supporting a different one of said lock members within said base and each biasing structure adapted to normally bias said lock member out of said locked position, (h) positioning means disposed within said base for selectively positioning said locking means between said locked position and said released position and including a first member mounted on said rod and movable therewith and two second members each attached to a different one of said biasing structures and movable therewith along with respective ones of said lock members between said locked position and said released position, (i) said first member including opposed angularly oriented drive surfaces and each of said second members including an angularly oriented, correspondingly disposed driven surface relative to one of said angularly oriented drive surfaces and being positioned in substantially confronting relation to a corresponding one of said drive surfaces, and (j) a trigger means mounted on said handle and connected to said arm portion for moving said activating rod and said locking means connected thereto between said locked position and said released position.

2. An assembly as in claim 1 wherein said trigger means is movably mounted on said handle in an externally accessible location relative to a hand of a user gripping said handle and disposable into and out of movable driving engagement with said arm portion.

3. An assembly as in claim 2 further comprising a safety structure movably mounted on said handle into and out of said locking engagement with said trigger means, said locking engagement defined by restricting movement of said trigger means into driving engagement with said arm portion and restrictive movement of said actuating rod and locking means into said released position from said locked position.

4. An assembly as in claim 3 wherein said safety structure is movably mounted on said handle in engagable relation to at least one finger of the hand of the user and including a catch portion selectively positionable into and out of latched engagement with said trigger means.

5. An assembly as in claim 1 further comprising a safety structure movably mounted on said handle and positionable into and out of locking engagement with said trigger means, said locking engagement defined by restricting movement of said trigger means, said actuating rod and said locking means into said released position from said locked position.

6. An assembly as in claim 1 further comprising a biasing means mounted within said handle and disposed in biasing engagement with said arm portion of said activating rod for biasing said arm portion towards said trigger means.

7. An assembly as in claim 6 wherein said trigger means comprises a lever portion pivotally mounted in an externally accessible location on said handle and disposable against said biasing force into driving engagement with said arm portion.

8. An assembly as in claim 1 wherein said first member is movable between and in outwardly driving engagement with said second members, said first member and each of said second members including congruently configured and cooperatively oriented surface portions structurally adapted to translate longitudinal linear travel of said first member along the length of said base into concurrent transversely directed travel of said second member and respective ones of said lock members outwardly into said locked position and adjacent a normal biasing force of said biasing structures.

9. An assembly as in claim 1 further comprising roller means interposed between said drive and driven surface and adapted to facilitate outward positioning of said second members upon linear travel of said first member relative to said second members.

10. An assembly as in claim 1 wherein said locking means comprises a plurality of apertures formed on said leg portion in spaced relation to one another along the length of said leg portion and in aligned registerable relation with said lock members; at least two openings each formed in said base in aligned registerable relation with a different one of said stop members and different ones of said plurality of apertures.

11. An assembly as in claim 10 wherein each of said stop members is disposed and configured to pass concurrently into a different one of said openings and each of said different ones of said plurality of apertures to define said locked position and relative movement of said arm portion to said base under biasing influence of said biasing means.

12. An assembly as in claim 1 further comprising a biasing spring mounted within said leg member and connected between said base and said leg member to normally bias said leg member from said retracted position into said extended position.

* * * * *